US007862358B2

(12) United States Patent
Nishimatsu et al.

(10) Patent No.: US 7,862,358 B2
(45) Date of Patent: Jan. 4, 2011

(54) ELECTRICAL CONNECTOR

(75) Inventors: Norimasa Nishimatsu, Tokyo (JP); Fuminobu Tamura, Tokyo (JP)

(73) Assignee: Hirose Electric Co., Ltd., Tokyo (JP)

( * ) Notice: Subject to any disclaimer, the term of this patent is extended or adjusted under 35 U.S.C. 154(b) by 0 days.

(21) Appl. No.: 12/707,800

(22) Filed: Feb. 18, 2010

(65) Prior Publication Data

US 2010/0144184 A1 Jun. 10, 2010

Related U.S. Application Data

(63) Continuation of application No. 12/385,233, filed on Apr. 2, 2009, now Pat. No. 7,713,078, which is a continuation of application No. 12/010,923, filed on Jan. 31, 2008, now Pat. No. 7,530,831.

(30) Foreign Application Priority Data

Feb. 2, 2007 (JP) ..... 2007-024148

(51) Int. Cl.
*H01R 13/15* (2006.01)

(52) U.S. Cl. ..... 439/260; 439/495

(58) Field of Classification Search ..... 439/260, 439/495

See application file for complete search history.

(56) References Cited

U.S. PATENT DOCUMENTS

2004/0023551 A1 * 2/2004 Suzuki et al. ..... 439/495
2007/0049087 A1 3/2007 Hashimoto et al.

* cited by examiner

*Primary Examiner*—Ross N Gushi
(74) *Attorney, Agent, or Firm*—Kubotera & Associates LLC

(57) ABSTRACT

An electrical connector for a flat conductive member includes a housing having a bottom wall, a top wall, a first receiving groove, and a second receiving groove. The first receiving groove and the second receiving groove extend from a first side toward a second side. The connector includes a first terminal disposed in the first receiving groove; a second terminal disposed in the second receiving groove; and a pressing member disposed to be movable between an open position and a closed position for pressing the first terminal and the second terminal. The first terminal includes a first fixing arm portion contacting with the bottom wall, a first movable arm portion contacting with the top wall, and a first connecting portion. The second terminal includes a second fixing arm portion contacting with the bottom wall, a second movable arm portion contacting with the top wall, and a second connecting portion.

7 Claims, 7 Drawing Sheets

ELECTRICAL CONNECTOR

CROSS-REFERENCE TO RELATED APPLICATIONS

This is a continuation application of a prior application Ser. No. 12/385,233, filed Apr. 2, 2009, now U.S. Pat. No. 7,713,078, which is a continuation application of a prior application Ser. No. 12/010,923, filed Jan. 31, 2008, now U.S. Pat. No. 7,530,831.

BACKGROUND OF THE INVENTION AND RELATED ART STATEMENT

The present invention relates to an electrical connector for a flat conductor.

A Flexible Printed Circuit (FPC), a flat cable, and the likes are known as flat conductors. A connector disclosed in Patent Reference is known as an electrical connector that connects the flat conductor to a connection object member, for example, other circuit board.

Patent Reference: Japanese Patent Publication No. 11-031561

FIG. 6 is a perspective sectional view showing a conventional electrical connector. FIG. 7 is a partial perspective sectional view showing the conventional electrical connector.

In the connector disclosed in Patent Reference, as shown in FIGS. 6 and 7, a plurality of the terminals 51 is held in a housing 52 in a direction perpendicular to a plate surface thereof. The terminal 51 is made to maintain a plate surface of a metal sheet.

The terminal 51 has an approximate transverse H-shape. Further, each upper arm and lower arm of the terminal 51 is connected at a middle portion thereof in a longitudinal direction thereof. The upper arm elastically inclines and is displaceable as a lever with a connection portion thereof as a fulcrum. The upper arm is provided with a supporting arm 54A on a right side of a fulcrum portion 53.

Further, the upper arm is provided with a contact arm 54B having a contact portion 54C with a protrusion shape on a left side thereof. The lower arm is provided with a supporting arm 55A having a connection portion 55B on a distal end thereof on a right side of the fulcrum portion 53. Further, the lower arm is provided with a fixed arm 55D having a protrusion portion 55C on a left side.

The housing 52 is provided with grooves 56 corresponding to the terminals 51, so that the terminals 51 are inserted into the grooves 56. The terminals 51 can be inserted from a right side in FIG. 6. All of the grooves 56 communicate at a left opening 57 of the housing 52. Further, the grooves 56 communicate at a right opening 58 of the housing 52. A flat conductor is inserted between the contact arms 54B and the fixed arms 55D from the left opening 57. Further, the right opening portion 58 is provided with a pressing member 59 to be freely rotatable.

The pressing member 59 is made of an electrical insulation material similar to that of the housing 52. As shown in FIGS. 6 and 7, the pressing member 59 has an operation portion 59A, a rotation guided portion 59B, a pressing portion 59C that functions as a cam, and a shaft portion 59D.

The operation portion 59A protrudes from the right opening 58 of the housing 52 to be in a lever shape. The rotation guided portion 59B has a section having a circular arc shape and is rotated to guide in a recessed portion. The recessed portion is provided to correspond to the supporting arm 55A of the lower arm of the terminal 51. When the pressing member 59 is rotated to be at a close position in a clockwise direction in the operation portion 59A, the pressing portion 59C presses the supporting arm 54A of the upper arm of the terminal 51 upwardly.

The shaft portion 59D is provided to protrude from both ends of a width direction of the pressing member 59. The shaft portion 59D has a pivot on an extension of a centerline of the circular arc of the rotation guided portion 59B. The shaft portion 59D is supported to be movable and guided along with the rotation guided portion 59B when the pressing member 59 is rotated.

A taper groove portion 61 and a step groove portion 62 are provided inside of a sidewall 60 of the housing. The taper groove portion 61 and the step groove portion 62 are adjacent to each other. Further, a slit 64 is provided in each border portion of the sidewalls 60 and a top wall 63 of the housing. The slit 64 enables the sidewall 60 to elastically bend outwardly. The pressing member 59 is incorporated into the housing 52 from a right side in FIG. 6 and from an upper right side in FIG. 7.

At that time, the shaft portion 59D elastically deforms to bend the sidewall 60 outwardly to be accommodated in the step groove portion 62 while moving the taper groove portion 61 of the sidewall 60. When the shaft portion 59D is accommodated in the step groove portion 62, the elastic deformation to bend is released. Accordingly, the shaft portion 59D engages with the step groove portion 62 and becomes hard to disengage upon receiving an external force.

As described above, in the connector disclosed in Patent Reference, the shaft portion provided on both side edges of the pressing member engages with the step groove portion of the housing in an arrangement direction of the terminals, so that the pressing member does not come off.

When the number of the terminals increases, a width dimension between both side edges of the pressing member increases and becomes easier to bend. In a range between the both side edges, the recessed portion provided in the supporting arm of the terminal prevents the pressing member from coming off to some extent.

However, when the pressing member is bent as described above due to an external force, the rotation guided portion of the pressing member easily protrudes from the recessed portion. Accordingly, solely the shaft portion has to be depended on to prevent the pressing member from coming off. As a result, the shaft portion may be overloaded; an engagement depth with the step groove portion of the shaft portion may become small due to the bend described above; or the sidewall may open due to a large force from the shaft portion, thereby further decreasing the engagement depth.

When one of the situations described above occurs, the shaft portion may break or the pressing member may come off. That is, when the pressing member is opened and closed, or when an inadvertent external force is applied to the pressing member, the pressing member may come off. Accordingly, the flat conductor can lose contact with the terminal; and therefore, a function as the connector can be lost.

In view of the problems described above, an object of the present invention is to provide an electrical connector for a flat conductor, in which it is possible surely prevent a pressing member from coming off without enlarging a size of the electrical connector. Another object of the present invention is to provide an electrical connector that prevents a pressing member from coming off even though the number of terminals increases.

Further objects and advantages of the invention will be apparent from the following description of the invention.

SUMMARY OF THE INVENTION

In order to attain the objects described above, according to a first aspect of the present invention, an electrical connector for a flat conductor includes a terminal maintaining a flat surface of a metal sheet. The terminal includes a fixing arm portion and a movable arm portion each having an arm shape. The fixing arm portion and the movable arm portion extend in a same direction. The fixing arm portion and the movable arm portion are connected each other through a joining portion in a middle portion thereof in a longitudinal direction thereof to be an integrated member. Further, the fixing arm portion is held to fix through the housing.

The movable arm portion has a pressing portion on one end portion side thereof and a pressure receiving portion on the other end portion side thereof in a longitudinal direction thereof. When a pressing member moves in a specific direction, a cam portion of the pressing member presses the pressure receiving portion of the movable arm portion to be displaced on a surface including a plane of the terminal through a movement of a specific amount. Further, when the pressure receiving portion is displaced, the movable arm portion makes an angular displacement like a lever with the joining portion as a fulcrum to displace the pressing portion, so that the pressing portion applies pressure to the flat conductor.

In the electrical connector for a flat conductor described above, according to the first aspect of the present invention, a plurality of the terminals is arranged in a direction perpendicular to the flat surface of the terminals. The terminals include at least a first terminal and a second terminal. The first terminal and the second terminal are attached to the housing through press-fitting from opposite directions of the housing in a longitudinal direction.

The first terminal has a raised portion on a top edge portion of a fixing arm portion facing a pressure receiving portion of a movable arm portion thereof. Further, the first terminal is provided with a rotation guide portion to rotate and guide the cam portion of the pressing member while regulating a movement of the pressing member in a press-fit direction of the second terminal at the raised portion.

In the second terminal, a top edge portion of the fixing arm portion thereof is provided to be a straight portion extending in a longitudinal direction at a position corresponding to the rotation guide portion of the first terminal.

The cam portion comprises a small radius cam portion and a large radius cam portion. When the pressing member is at an open position, the small radius cam portion contacts or forms a space with the pressure receiving portions of the movable arm portions of the first and the second terminals. When the pressing member is at a close position, the large radius cam portion has a cam radius larger than that of the small radius cam portion, and applies a contact pressure against the pressure receiving portion.

A space is formed between a maximum rise position of the raised portion of the first terminal and a bottom edge portion of the movable arm portion that faces the raised portion, so that the cam portion can be inserted over with respect to a terminal arrangement direction. Further, when a space is formed between the bottom edge portion of the movable arm portion that faces the straight portion of the fixing arm portion of the second terminal and the cam portion, the space becomes smaller than a maximum rise height of the raised portion with respect to the terminal arrangement direction.

When the electrical connector for a flat conductor is assembled, the first terminal, the pressing member, the second terminal are attached to the housing in sequence. More specifically, first, the first terminal is pressed fit from a pressing portion side of the first terminal in a longitudinal direction of the first terminal. Further, the cam portion of the pressing member is inserted over in a press-fit direction of the first terminal between the movable arm portion of the first terminal and the raised portion of the fixing arm portion and the pressing member is attached.

In the first aspect of the present invention, when the cam portion of the pressing member is inserted over, the space is formed between the maximum rise position of the raised portion of the first terminal and the bottom edge portion of the movable arm portion that faces the raised portion, so that the cam portion can be inserted over with respect to the terminal arrangement direction. Accordingly, the pressing member can be inserted over between the movable arm portion of the first terminal and the raised portion of the fixing arm portion without problems.

After the pressing member is arranged, the second terminal is pressed fit into the housing from the pressure receiving portion side of the second terminal in an opposite direction of the press-fit direction of the first terminal in a terminal longitudinal direction.

In the connector for a flat conductor assembled as described above, an upward movement of the cam portion corresponding to the second terminal is regulated through the movable arm portion of the second terminal. Accordingly, an upward movement of the first terminal is also regulated.

Further, when the space is formed between the bottom edge portion of the movable arm portion that faces the straight portion of the fixing arm portion of the second terminal and the cam portion of the pressing member, the space becomes smaller than the maximum rise height of the raised portion of the first terminal with respect to a terminal arrangement direction.

Accordingly, even though the pressing member is lifted due to an external force, the cam portion corresponding to the first terminal cannot be above the raised portion. Thus, the cam portion corresponding to the first terminal does not come off. Accordingly, a coming off of the cam portion corresponding to the second terminal is also prevented. As a result, the pressing member is prevented from coming off from the housing.

According to a second aspect of the present invention, in an electrical connector for a flat conductor, a plurality of terminals is arranged in a direction perpendicular to a flat surface of the terminals. The terminals include at least a first terminal and a second terminal.

The first terminal and the second terminal are pressed fit into a housing from opposite directions thereof each other in a longitudinal direction thereof. Further, the first terminal has a raised portion in a top edge portion of a fixing arm portion that faces a pressure receiving portion of a movable arm portion.

A rotation guide portion is provided in the raised portion to rotate to guide a cam portion of a pressing member while regulating a movement of the pressing member in a press-fit direction of the second terminal.

In the second terminal, a top edge portion of a fixing arm portion thereof is provided to be a straight portion extending in a longitudinal direction thereof at a position corresponding to the rotation guide portion of the first terminal.

The cam portion comprises a small radius cam portion and a large radius cam portion. When the pressing member is at an open position. the small radius cam portion provides a contact or a space against the pressure receiving portions of the movable arm portions of the first and the second terminals. When the pressing member is at a close position, the large radius cam portion has a cam radius larger than that of the small radius cam portion and applies contact pressure against the pressure receiving portion.

A space is formed between a maximum rise position of the raised portion of the first terminal and a bottom edge portion of the movable arm portion that faces the raised portion, so that the cam portion can be inserted over with respect to a terminal arrangement direction. Further, a space is formed between the bottom edge portion of the movable arm portion that faces the straight portion of the fixing arm portion of the second terminal and the maximum rise position of the raised portion of the first terminal, so that the cam portion cannot be passed through with respect to the terminal arrangement direction.

In the electrical connector for a flat conductor with the configuration described above, the cam portion corresponding to the first terminal cannot pass through a space formed between the bottom edge portion of the movable arm portion that faces the straight portion of the fixing arm portion of the second terminal and the maximum rise position of the raised portion of the first terminal. Accordingly, it is possible to prevent the cam portion of the pressing member from coming off, and the pressing member from being detached from the housing.

In the electrical connector for a flat conductor with the configuration described above, each cam portion of the pressing member is provided to be identical in a shape and a dimension at a position at which a section thereof on a surface parallel to the flat surface of the terminal corresponds to the position of the first terminal and the second terminal, respectively.

Further, the top edge portions of the fixing arm portion of the first and the second terminals are provided at the same position in a top-to-bottom direction in which the fixing arm portion and the movable arm portion face each other. The second terminal is provided so that the bottom edge portion of the movable arm portion of the second terminal is positioned below the bottom edge portion of the movable arm portion of the first terminal in the top-to-bottom direction. Accordingly, the electrical connector for a flat conductor is practicable.

Further, in the electrical connector for a flat conductor with the configuration described above, in the first and second aspects of the present invention, the first and the second terminals are provided so that each of the bottom edge portions of the movable arm portions and the top edge portions of the fixing arm portions are in the same position in a top-to-bottom direction.

The top-to-bottom direction is a facing direction of the fixing arm portion and the movable arm portion. Further, when the pressing member is at an open position, the cam portion of the pressing member in a top-to-bottom direction at a section on a surface parallel to a flat surface of the second terminal becomes larger than the corresponding dimension of the cam portion in the top-to-bottom direction at a position of the first terminal. Accordingly, the electrical connector for a flat conductor is practicable.

It is preferred that a mix of the first and the second terminals are distributed and arranged in an arrangement direction of the terminals and held through the housing. Accordingly, the first and the second terminals are arranged over all in a terminal arrangement direction. Further, it is attempted that the cam portion of the pressing member is prevented from coming off in an entire arrangement direction; therefore, an effect to prevent the pressing member from coming off will be improved.

Further, in the first and second aspects of the present invention, it is preferred that the pressure receiving portion of the movable arm portion of the first terminal is straight, and the pressure receiving portion of the movable arm portion of the second terminal is recessed.

As described above, the pressure receiving portion of the movable arm portion of the second terminal is recessed. Accordingly, the cam portion corresponding to the second terminal engages with the pressure receiving portion having a recessed shape. Thus, the cam portion corresponding to the second terminal can be positioned in a terminal longitudinal direction.

Further, the first and the second terminals are pressed fit each other from the opposite directions, which can cause a deviation in a terminal longitudinal direction or an assembly error. However, the pressure receiving portion of the movable arm portion of the first terminal is straight, so that the movable arm portion is displaced upwardly through the pressure from the cam portion without problems even though relative positions of the cam portion and the pressure receiving portion are slightly out of alignment.

In the present invention, when the connector is assembled, the cam portion of the pressing member is inserted over between the movable arm portion and the fixing arm portion of the first terminal, so that the pressing member is incorporated into the housing.

Further, after the pressing member is arranged, the movable arm portion of the second terminal regulates an upward movement of the cam portion of the pressing member, and the raised portion of the first terminal regulate a movement of the cam portion in the press-fit direction of the second terminal. Accordingly, the cam portion does not come off and the pressing member is prevented from coming off from the housing.

Further, the first terminal and the second terminal prevent the cam portion from coming off and a separate member is not required to prevent the cam portion from coming off. Thus, the connector is not enlarged.

Further, a mix of the first and the second terminals is distributed and arranged in a terminal arrangement direction, and the first and the second terminals are arranged over all in the terminal arrangement direction, so that the cam portion is prevented from coming off. Accordingly, an effect to prevent the pressing member from coming off will be improved.

Specifically, when the number of the terminals is large and a width of the pressing member in the terminal arrangement direction is large, the flexure of the pressing member is to effectively prevent the pressing member from coming off.

BRIEF DESCRIPTION OF THE DRAWINGS

FIGS. 1(A) and 1(B) are views showing an electrical connector for a flat conductor according to a first embodiment of the present invention, wherein FIG. 1(A) is a plan view thereof, and FIG. 1(B) is a front view thereof;

FIGS. 2(A) to 2(C) are views showing the electrical connector for a flat conductor according to the first embodiment of the present invention, wherein FIG. 2(A) is a sectional view taken along a line 2(A)-2(A) in FIG. 1(B), FIG. 2(B) is a sectional view taken along a line 2(B)-2(B) in FIG. 1(B), and FIG. 2(C) is a sectional view taken along a line 2(C)-2(C) in FIG. 1(B);

FIGS. 3(A) to 3(D) are views showing the electrical connector for a flat conductor according to the first embodiment of the present invention, wherein FIGS. 3(A) and 3(B) are sectional views thereof at a position of a first terminal in a terminal arrangement direction, and FIGS. 3(C) and 3(D) are sectional views thereof at a position of a second terminal in the terminal arrangement direction;

FIGS. 4(A) and 4(B) are views showing the electrical connector for a flat conductor according to the first embodiment of the present invention, wherein FIG. 4(A) is a view showing a top-to-bottom dimension of a space formed between a cam portion and the first terminal after a pressing member is attached, and FIG. 4(B) is a view showing a top-to-bottom dimension of a space formed between the cam portion and the second terminal after the second terminal is attached;

DETAILED DESCRIPTION OF PREFERRED EMBODIMENTS

Hereunder, embodiments of the present invention will be explained with reference to the accompanying drawings.

First Embodiment

Figure 1:
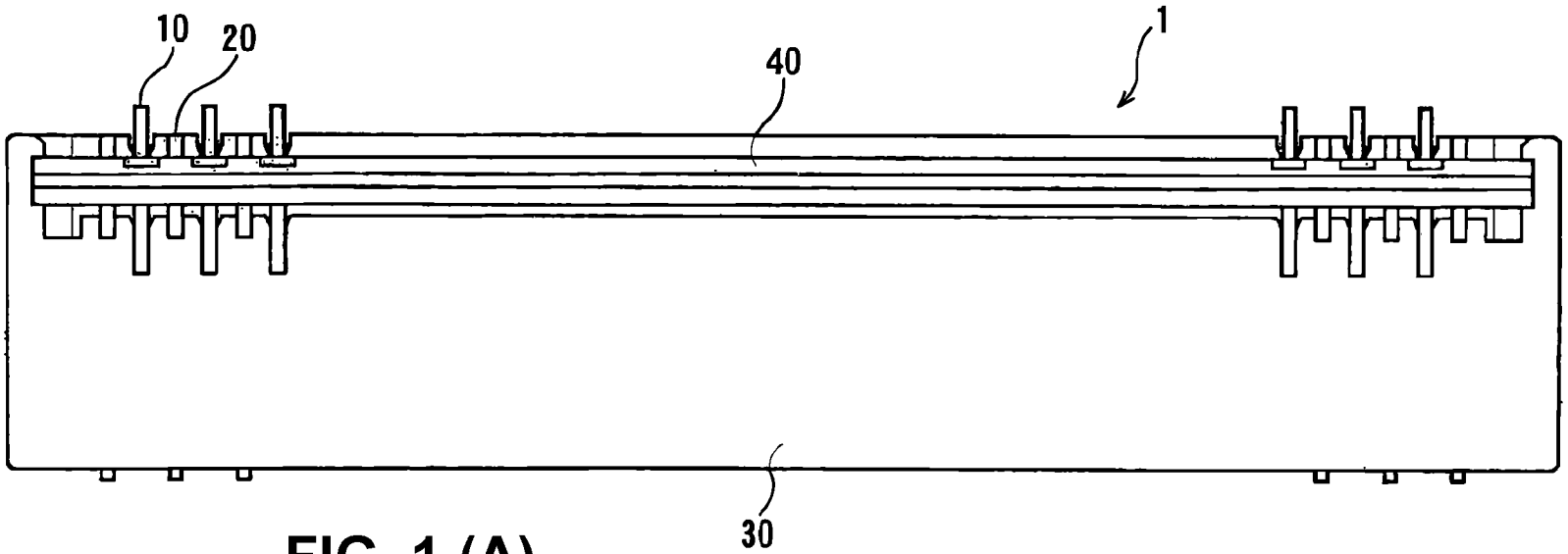
Figure 1:
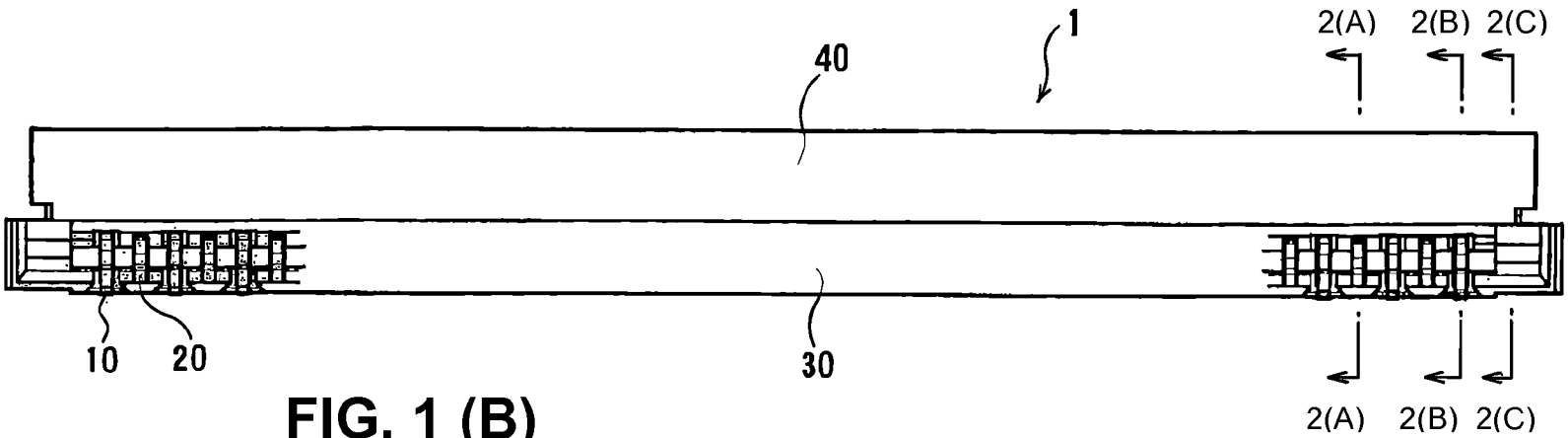

FIGS. 1(A) and 1 electrical (B) are views showing an electrical connector for a flat conductor according to a first embodiment of the present invention. More specifically, FIG. 1(A) is a plan view of the electrical connector, and FIG. 1(B) is a front view of the electrical connector.

As shown in FIGS. 1(A) and 1(B), in an electrical connector 1 for a flat conductor, a plurality of terminals made through maintaining a flat surface of a metal sheet is arranged at a specific interval in a direction perpendicular to a flat surface of the terminal. The two different kinds of terminals are provided; that is, first terminals 10 and second terminals 20.

As shown in FIGS. 1(A) and 1(B), the first terminals 10 and the second terminals 20 are arranged alternately in a housing 30 in a longitudinal direction thereof. The housing 30 has an outer shape of an approximate rectangular solid. Further, pressing members 40, to be described below, are attached to the housing 30 to be freely rotatable. The pressing members 40 are provided to contact the first terminals 10 and the second terminals 20 to a flat conductor. Hereinafter, for convenience of explanation, the first terminal 10 can be referred to as the "terminal 10", and the second terminal 20 as the "terminal 20".

FIGS. 2(A) to 2(C) are views showing the electrical connector for a flat conductor according to the first embodiment of the present invention. More specifically, FIG. 2(A) is a sectional view taken along a line 2(A)-2(A) in FIG. 1(B) and shows a section pf the electrical connector 1 at a position of the first terminal 10 in a terminal arrangement direction. FIG. 2(B) is a sectional view taken along a line 2(B)-2(B) in FIG. 1(B) and shows a section at a position of the second terminal 20 in the direction. FIG. 2(C) is a sectional view taken along a line 2(C)-2(C) in FIG. 1(B) and shows a section in an end portion position outside of a terminal arrangement range in the direction.

As shown in FIGS. 2(A) to 2(C), the pressing member 40 is situated at an open position. Here, the "open position" means a position in which the pressing member 40 rises in a height direction of the housing 30 so that the flat conductor can be inserted inside of the housing 30.

The housing 30 has a rectangular section and extends in a direction perpendicular to a sheet surface. Further, the housing 30 is formed of an insulation member and is provided with receiving grooves 31 and 32 to accommodate the two kinds of the terminals; the terminals 10 and 20, respectively.

Each of the receiving grooves 31 and 32 has a slit shape that extends to be parallel to a sheet surface within an inside width (inside width in a direction perpendicular to a sheet surface) according to a plate thickness of the terminals 10 and 20, respectively.

Further, each of the receiving grooves 31 and 32 pierces the housing 30 left to right as shown in FIGS. 2(A) and 2(B). All the receiving grooves 31 and 32 communicate with each other in a right half portion of the housing 30 in an area covering from a middle portion in a top-to-bottom direction to an upper portion and a pressing member rotation space 33 that is open upwardly is formed.

Further, all the receiving grooves 31 and 32 communicate in a left half portion of the housing 30 in a middle portion of a top-to-bottom direction and a flat conductor insertion space 34 that is open to left is formed. Accordingly, the receiving grooves 31 and 32 are formed in a portion along an inside surface of a housing bottom wall 35 and a top wall 36 inside of the housing 30, respectively. A top wall 36 is positioned in a left half portion.

The terminals 10 and 20 are formed through maintaining flat surfaces of metal sheets as described above. As shown in FIGS. 2(A) to 2(C), outer shapes of the terminals 10 and 20 are approximate transverse H shape. The terminals 10 and 20 have fixing arm portions 11 and 21 and movable arm portions 12 and 22, respectively.

In the embodiment, the fixing arm portions 11 and 21 are positioned on the down side. The movable arm portions 12 and 22 are positioned above and substantially parallel to the fixing arm portions 11 and 21, respectively. The fixing arm portions 11 and 21 and the movable arm portions 12 and 22 are connected through joining portions 13 and 23, respectively, in a middle portion of a longitudinal direction to be an integrated member.

The first terminal 10 has a contact portion 11A and a connection portion 11B. The contact portion 11A having a protrusion shape is provided to face the movable arm portion 12 on a left end of the fixing arm portion 11 extending near a left end of the housing 30. The connection portion 11B is provided on a right end protruding outwardly from the housing 30.

Further, the fixing arm portion 11 of the first terminal 10 has a protrusion portion 11C and a cam guide portion 11D. The protrusion portion 11C is provided on a right side of the joining portion 13. The cam guide portion 11D is formed in a groove shape between the protrusion portion 11C and the connection portion 11B.

In the embodiment, a groove bottom portion of the cam guide portion 11D forms a straight line portion and has rounded portions on both sides. A portion from the groove bottom portion to the connection portion 11B through the rounded portion on the right side of the cam guide portion 11D constitutes a raised portion 11E.

A rotation guide portion 11E-1 is formed in the raised portion 11E to rotate to guide a cam portion 43 of the pressing member 40, as to be described below. Further, the rotation guide portion 11E-1 also plays a role in regulating a movement of the pressing member 40 to a right direction. The connection portion 11B is provided in a portion that protrudes outwardly from the housing 30 and extends downwardly. Further, a fixed groove 11F to fit into a right end portion of the bottom wall 35 of the housing is provided.

The movable arm portion 12 of the first terminal 10 is connected with the fixing arm portion 11 through the joining portion 13. Further, the movable arm portion 12 of the first terminal 10 extends left to right with respect to a position of the joining portion 13. On a left end of the movable arm portion 12, a pressing portion 12A is provided at a position corresponding to the contact portion 11A of the fixing arm portion 11 and protrudes to the left end to face the contact portion 11A.

In the embodiment, the movable arm portion 12 has a pressure receiving portion 12B near a right end of the movable arm portion 12 in a straight portion that faces the raised portion 11E of the fixing arm portion 11. A bottom edge of the position that faces the cam guide portion 11D of the fixing arm portion 11 constitutes a straight portion.

The first terminal 10 is pressed into the receiving groove 31 of the housing 30 from a right end side thereof. The fixing arm portion 11 is accommodated in the receiving groove 31 on the bottom wall 35 side of the housing 30, while the movable arm portion 12 is accommodated in the receiving groove 31 on a side of the top wall 36.

In the embodiment, the bottom edge of the fixing arm portion 11 contacts with an upper face of the bottom wall 35 of the housing 30. The fixed groove 11F provided in the connection portion 11B fits into a right end portion of the bottom wall 35 of the housing to fix the fixing arm portion 11 securely. On the other hand, the top edge of the movable arm portion 12 bites into the top wall 36 of the housing 30 in a narrow range at a position P1 corresponding to the joining portion 13 in a terminal longitudinal direction. Accordingly, the joining portion 13 can function as a fulcrum.

In the embodiment, in the other ranges, a space is formed between the top edge of the movable arm portion 12 and a lower surface of the top wall 36 of the housing 30. Accordingly, the movable arm portion 12 can work as a lever at the fulcrum. Thus, the movable arm portion 12 is elastically displaceable in a top-to-bottom direction while supported in an inner wall surface of a groove width direction of the receiving groove 31 in a plate thickness direction of the movable arm portion 12. A part of the movable arm portion 12 that is on a right side of the joining portion 13 enters the pressing member rotation space 33 in which no top wall 36 of the housing 30 exists.

In the embodiment, the fixing arm portion 21 of the second terminal 20 extends to a left side of the joining portion 23. Further, a distal portion of the fixing arm portion 21 protrudes outwardly from the housing 30. The terminal 20 has a connection portion 21B outside of the housing and a contact portion 21A between the connection portion 21B and the joining portion 23.

The connection portion 21B has a shape similar to a shape of a left-right reversal of the connection portion 11B of the first terminal 10. Further, the connection portion 21B is provided with a fixed groove 21F that is fitted into a left end portion of the bottom wall 35 of the housing 30. The contact portion 21A is positioned on a right side of the contact portion 11A of the first terminal 10.

A top edge of a part of the fixing arm portion 21 that is on the right side of the joining portion 23 facing the movable arm portion 22 through a free edge constitutes a straight edge, a part of which provides a cam guide portion 21D. The cam guide portion 21D guides and supports a cam portion 44 of the pressing member 40, to be described later. That is, the top edge of the fixing arm portion 21 is provided as a straight portion at a position corresponding to the rotation guide portion 11E-1 of the first terminal 10.

In the embodiment, the top edge of the fixing arm portion 21 and a top edge of the fixing arm portion 11 of the first terminal 10 are provided in the same position in a top-to-bottom direction. The top-to-bottom direction is a facing direction of the fixing arm portions 11 and 21 and the movable arm portions 12 and 22, respectively.

The movable arm portion 22 of the second terminal 20 is connected with the fixing arm portion 21 through the joining portion 23. Further, the movable arm portion 22 of the second terminal 20 extends left to right with respect to a position of the joining portion 23. A part of the movable arm portion 22 on the left side of the joining portion 23 extends shorter than the case of the first terminal 10. A left end of the movable arm portion 22 has a pressing portion 22A.

In the embodiment, the pressing portion 22A protrudes against the contact portion 21A of the fixing arm portion 21. A part of a top edge of the movable arm portion 22 on the left side of the joining portion 23 bites into the top wall 36 of the housing 30 in a narrow range at a position P2 corresponding to the joining portion 23 in a terminal longitudinal direction. Accordingly, the joining portion 23 is assured to function as a fulcrum.

In the other ranges, a space is formed between the top edge of the movable arm portion 22 and a lower surface of the top wall 36 of the housing 30. Accordingly, the movable arm portion 22 can work as a lever at the fulcrum. Thus, the movable arm portion 22 can be elastically displaced in the other ranges in a top-to-bottom direction. Further, a pressure receiving portion 22B having a recessed shape is provided in a part of the movable arm portion 22 on a right end portion on a right side of the joining portion 23.

More specifically, the pressure receiving portion 22B is provided in a portion corresponding to a rotation center 44A of the cam portion 44, to be described below, in a longitudinal direction of the movable arm portion 22. A bottom edge near the pressure receiving portion 22B of the movable arm portion 22 of the second terminal 20 is provided below a bottom edge near the pressure receiving portion 12B of the movable arm portion 12 of the first terminal 10 in a top-to-bottom direction.

As compared to the first terminal 10, the second terminal 20 having the shape described above has a transverse H-shape as a whole and is similar to the first terminal 10. The second terminal 20 differs from the first terminal 10 in the following points; the second terminal 20 is attached to the housing 30 from a left side; the contact portion 21A of the fixing arm portion 21 and the pressing portion 22A of the movable arm portion 22 are positioned to approach the joining portion 23, respectively; the cam guide portion 21D of the fixing arm portion 21 is provided to be straight; the pressure receiving portion 22B of the movable arm portion 22 is provided to be in a recessed shape; and a bottom edge near the pressure receiving portion 22B of the movable arm portion 22 is provided below a bottom edge near the pressure receiving portion 12B of the movable arm portion 12 of the first terminal 10.

The pressing member 40 is formed of an insulation member such as a resin or the like. The pressing member 40 is provided to extend outwardly from an inside of the housing shown in FIGS. 2(A) to 2(C). Further, the pressing member 40 has a width that covers an arrangement range of the terminals 10 and 20 in a direction perpendicular to a sheet surface; that is, a terminal arrangement direction.

In the embodiment, the pressing member 40 has groove portions 41 and 42 having slit shapes at a position corresponding to the terminals 10 and 20, respectively, in an approximately middle position inside of the housing 30 in the arrangement direction. The groove portions 41 and 42 are parallel to a sheet surface and allow the movable arm portions 12 and 22 of the terminals 10 and 20 to pierce through the groove portions 41 and 42, respectively.

The cam portions 43 and 44 are provided in the groove portions 41 and 42 in the edge portion position of the pressing member 40, respectively. The cam portions 43 and 44 connect the facing inner wall surfaces of the groove portions 41 and 42 (inner wall surfaces facing each other in an arrangement direction), respectively. Each of the cam portions 43 and 44 has a small radius cam portion and a large radius portion when the pressing member 40 is at an open position as shown in FIGS. 2(A) and 2(B).

In the embodiment, each section of the cam portions 43 and 44 is an oval shape having long sideways.

As shown in FIGS. 2(A) and 2(B), a distance from each of a rotation center 43A and the rotation center 44A, to be described below, to a top edge is the small radius cam portion, while a distance from the rotation centers to a left end is the large radius cam portion.

When the small radius cam portions of the cam portions 43 and 44 are upward, a space is formed between the cam portions 43 and 44 and the pressure receiving portion 12B and 22B, respectively. That is, when the pressing member 40 is at an open position, a space is formed between the cam portions 43 and 44 and the movable arm portions 12 and 22, respectively.

As shown in FIGS. 2(A) and 2(B), a distance from the left end to the right end of each of the cam portions 43 and 44 is larger than a space formed between the cam guide portions 11D and 21D and the pressure receiving portions 12B and 22B, respectively. That is, when the pressing member 40 is at a close position, the large radius portions apply contact pressure to the pressure receiving portions 12B and 22B.

In the embodiment, when the pressing member 40 is at an open position, a space is to be formed between the cam portions 43 and 44 and the movable arm portions 12 and 22, respectively. When the pressing member 40 is at an open position, the cam portions 43 and 44 and the movable arm portions 12 and 22 can contact each other, respectively, as far as the contact pressure is not generated.

The cam portion 43 and the cam portion 44 are identical in shapes and dimensions. The cam portion 43 corresponds to the first terminal 10, while the cam portion 44 corresponds to the second terminal 20. That is, the cam portion 43 corresponding to the first terminal 10 and the cam portion 44 corresponding to the second terminal 20 have the same cam displacement amounts.

In the embodiment, the cam portions 43 and 44 have a common rotation axial line. The common rotation axial line extends in a direction perpendicular to a sheet surface in the rotation centers 43A and 44A that are centers of a right side half circle portion shown in FIGS. 2(A) and 2(B). The pressure receiving portions 12B and 22B of the terminals 10 and 20 receive pressures from the cam portions 43 and 44, respectively, through a rotation operation of the pressing member 40 to a close position indicated by a two-dot hidden line in FIGS. 2(A) and (B).

Accordingly, the pressure receiving portions 12B and 22B of the terminals 10 and 20 are elastically displaced upwardly according to the cam displacement amounts. The elastic displacements of the pressure receiving portions 12B and 22B provide elastic displacements of the pressing portions 12A and 22A downwardly, respectively, through generating displacements in which the movable arm portions 12 and 22 incline as levers with the joining portions 13 and 23 as fulcrums, respectively.

Figure 2:
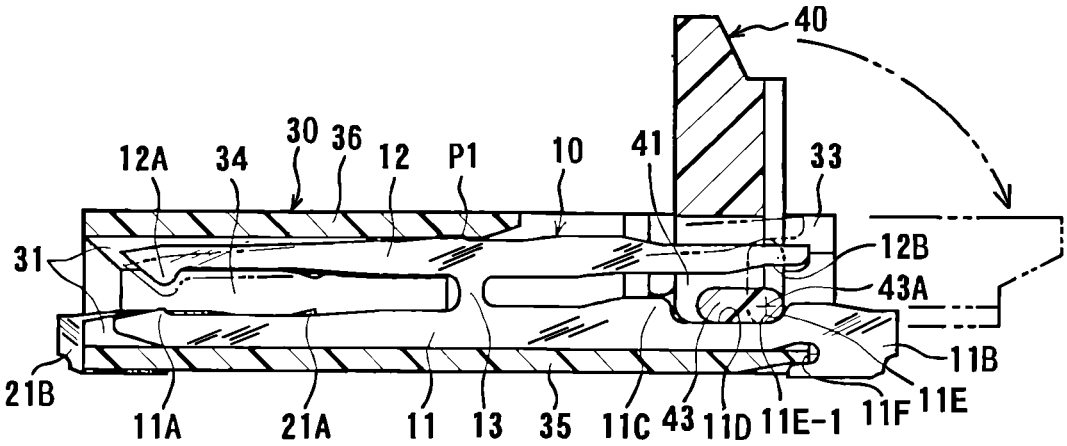
Figure 2:
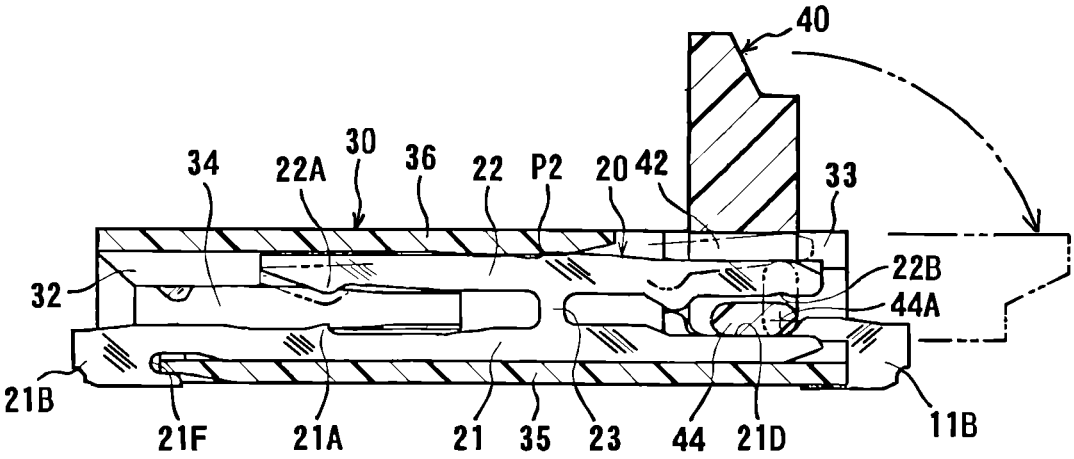
Figure 2:
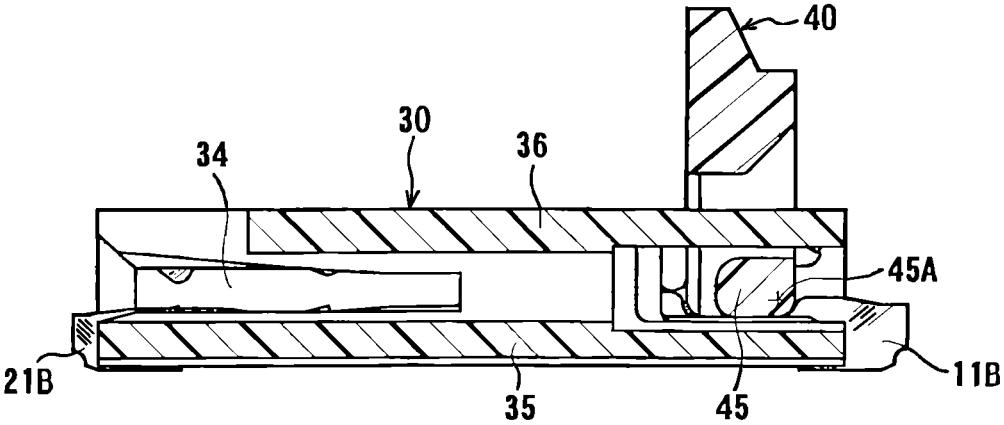

As shown in FIG. 2(*c*), on both ends in a direction perpendicular to a sheet, the pressing member 40 is provided with a side edge rotation portion 45 having an approximate rectangular section at a position to correspond to the cam portions 43 and 44 in the pressing member 40 with respect to a terminal arrangement direction, i.e., outside of a range corresponding to the terminal arrangement range.

In the embodiment, a rotation center 45A of the side edge rotation portion 45 rotates along a rotation of the pressing member 40 and has a common rotation axial line with the rotation centers 43A and 44A of the cam portions 43 and 44, respectively.

When the pressing member 40 is at an open position, the side edge rotation portion 45 is sized in a top-to-bottom direction so that the cam portion 43 of the pressing member 40 will not be above the raised portion 11E of the first terminal 10 even though the pressing member 40 at an open position is lifted to an upper direction.

The electrical connector 1 with the configuration described above is assembled as follows. FIGS. 3(A) to 3(D) are views showing the electrical connector 1 for a flat conductor according to the first embodiment of the present invention. More specifically, FIGS. 3(A) and 3(B) are sectional views thereof at a position of the first terminal 10 in a terminal arrangement direction. FIGS. 3(C) and 3(D) are sectional views thereof at a position of the second terminal 20 in the terminal arrangement direction.

First, when the connector 1 is assembled, a plurality of the first terminals 10 passes the pressing member rotation space 33 of the housing 30, and is pressed from the pressing portion 12A side to fit into the receiving grooves 31 to be attached to the housing 30 in a terminal longitudinal direction. That is, the first terminal 10 is pressed into the receiving groove 31 from a right side shown in FIG. 3(A).

As a result, the fixed groove 11F of the first terminal 10 is fitted into a right end portion of the bottom wall 35 of the housing 30. Further, a top edge of the movable arm portion 12 bites into the top wall 36 of the housing 30 in a narrow range in the position P1 corresponding to the joining portion 13 in the terminal longitudinal direction. Accordingly, the first terminal 10 is attached to the housing 30.

Next, the pressing member 40 is attached to the housing 30. More specifically, the cam portion 43 of the pressing member 40 is inserted over between the fixing arm portion 11 and the movable arm portion 12 to the left direction of the figure as indicated by an arrow while the pressing member 40 maintains the open position as shown in FIG. 3(A).

After the insertion, the pressing member 40 is moved downwardly to be incorporated into the housing 30. Accordingly, a bottom side of a right side half circle portion of the cam portion 43 of the pressing member 40 attached to the housing 30 is supported through the rotation guide portion 11E-1 of the first terminal 10, as shown in FIG. 3(B).

Figure 4:
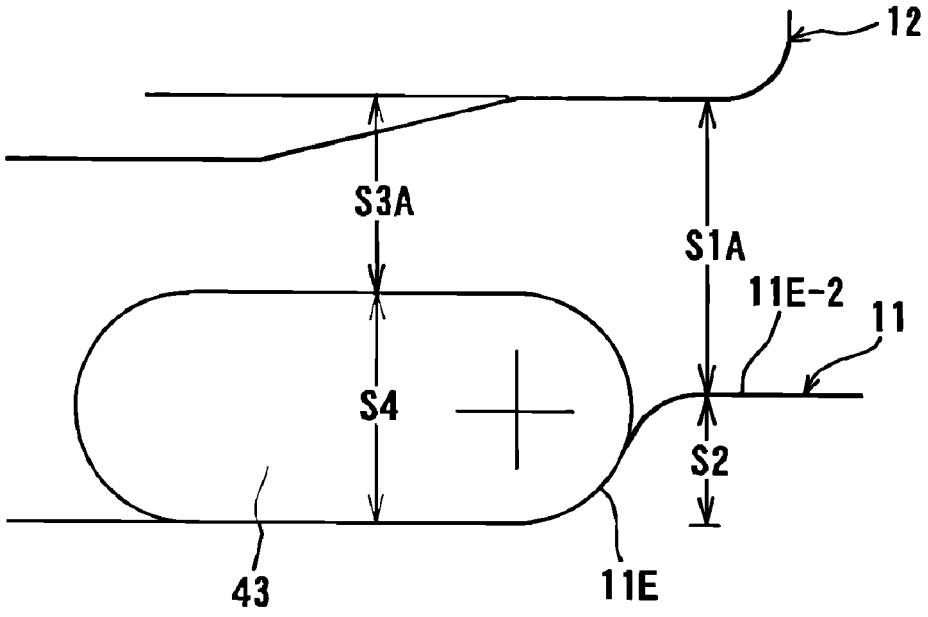
Figure 4:
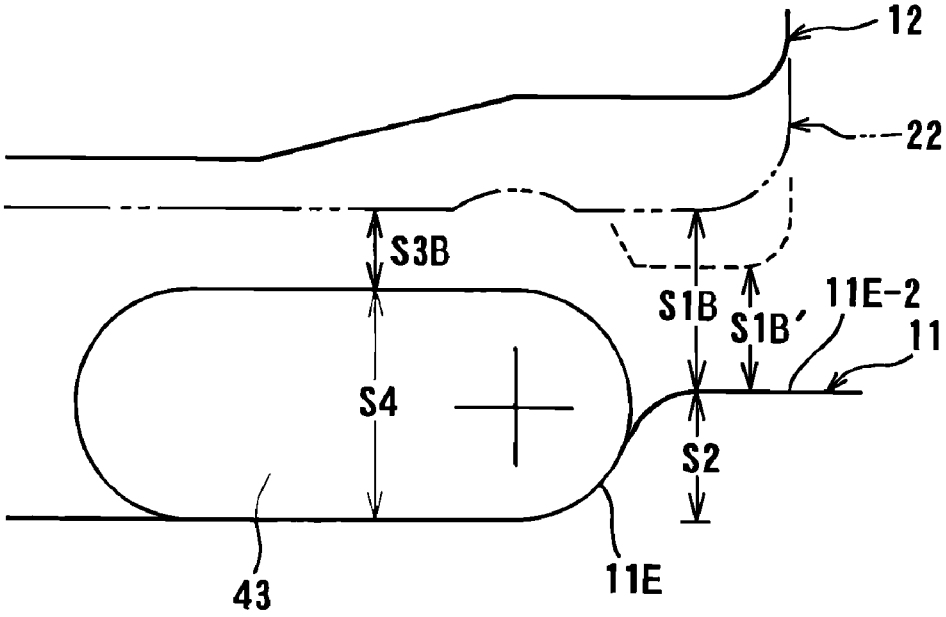

FIG. 4(A) is a view showing a top-to-bottom dimension of a space formed between the cam portion 43 and the first terminal 10 after the pressing member 40 is attached. In the first terminal 10, a dimension of a space (S1A) is formed to be larger than a top-to-bottom dimension (S4) of the cam portion 43 when the pressing member 40 is at an open position.

In the embodiment, the S1A is formed between a maximum rise position 11E-2 of the raised portion 11E of the first terminal 10 and a bottom edge portion of the movable arm portion 12 facing the raised portion 11E. In other words, a dimension of the maximum rise height of the raised portion 11E of the first terminal 10 (S2) is smaller than a dimension of a space formed between the bottom edge portion of the movable arm portion 12 of the first terminal 10 and the cam portion 43 in a top-to-bottom direction (S3A). The first terminal 10 is formed in such dimensions, which enables the cam portion 43 of the pressing member 40 to be inserted over when the pressing member 40 is attached.

As described above, the top-to-bottom dimension of the side edge rotation portion 45 when the pressing member 40 is at an open position is set, so that the cam portion 43 of the pressing member 40 is not above the raised portion 11E of the first terminal 10 even though the pressing member 40 at an open position is lifted. Accordingly, after the pressing member 40 is attached and before the second terminal is attached, the side edge rotation portion 45 prevents the pressing member 40 from coming off on both end positions of the pressing member 40 in a terminal arrangement direction.

Figure 3:
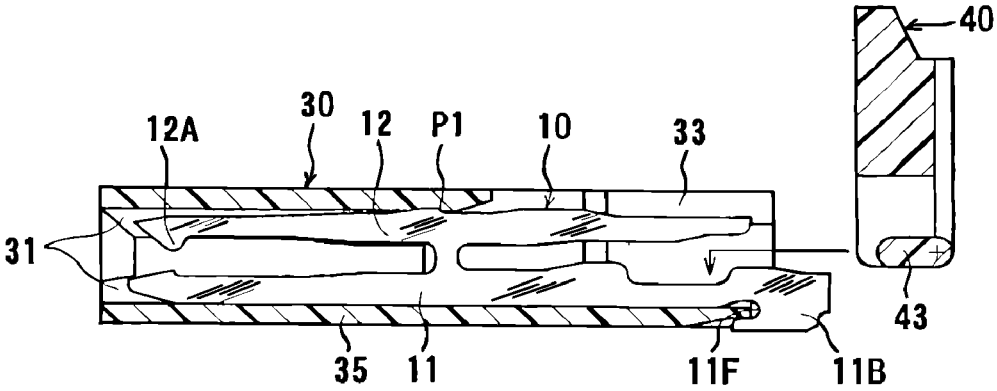
Figure 3:
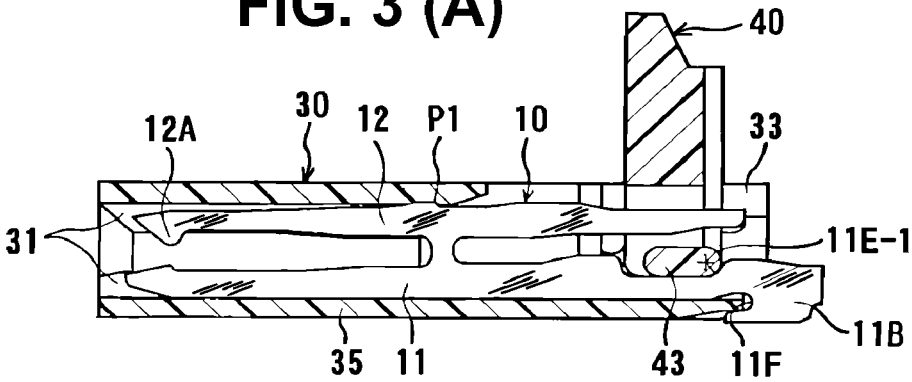
Figure 3:
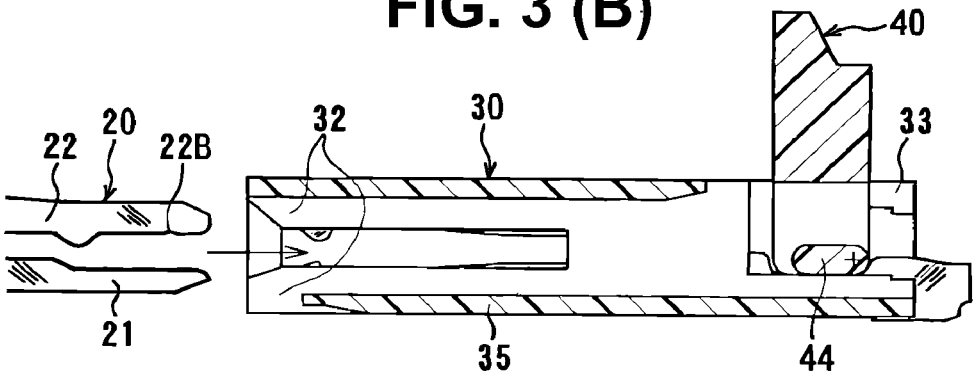
Figure 3:
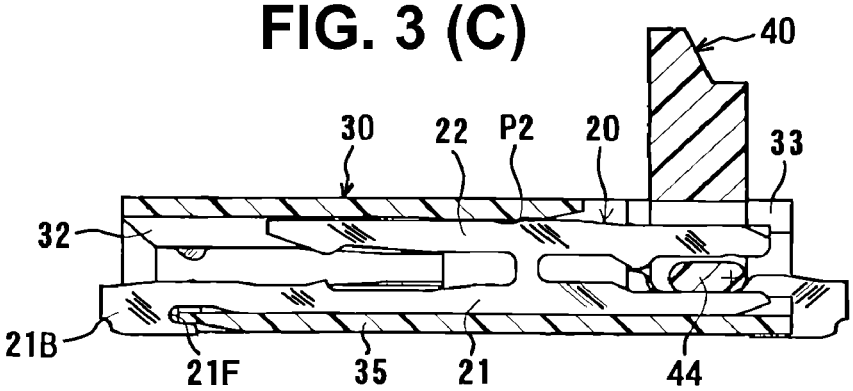

As shown in FIG. 3(B), after the first terminal 10 and the pressing member 40 are attached to the housing 30, a plurality of the second terminals 20 is attached to the housing 30 from an opposite side of a press-fit direction in a longitudinal direction of the terminal 10; that is, from a left side in FIG. 3(*c*).

More specifically, the second terminal 20 is pressed to fit into the receiving groove 32 to be attached from the pressure receiving portion 22B side in a terminal longitudinal direction as indicated by an arrow in the figure. As a result, as shown in FIG. 3(D), the fixed groove 21F of the second terminal 20 is fitted into a left end portion of the bottom wall 35 of the housing 30. Further, a top edge of the movable arm portion 22 bites into the top wall 36 of the housing 30 in a narrow range of the position P2 corresponding to the joining portion 23 in the terminal longitudinal direction so that the second terminal 20 is attached to the housing 30. Accordingly, an assembly of the connector 1 is completed.

FIG. 4(B) is a view showing a top-to-bottom dimension of a space formed between the cam portion 43 and the second terminal 20 after the second terminal 20 is attached.

As described above, the bottom edge of the movable arm portion 22 of the second terminal 20 is provided below the bottom edge of the movable arm portion 12 of the first terminal 10 in a top-to-bottom direction. The second terminal 20 is formed, so that a dimension of a space formed between the bottom edge portion of the movable arm portion 22 of the second terminal 20 indicated by the two-dot hidden line and the maximum rise position 11E-2 of the raised portion 11E of the first terminal 10 (S1B) is smaller than a dimension of the cam portion 43 in a top-to-bottom direction (S4).

In other words, a dimension of a space formed between the bottom edge portion of the movable arm portion 22 of the second terminal 20 and the cam portion 43 in a top-to-bottom direction (S3B) is smaller than a dimension of the maximum rise height of the raised portion 11E of the first terminal 10 (S2).

A shape and dimension of the cam portion 44 of the pressing member 40 is identical to that of the cam portion 43. Accordingly, at a position of the second terminal 20 in a terminal arrangement direction, a space between the bottom edge portion of the movable arm portion 22 of the second terminal 20 and the cam portion 44 is equal to the S3B shown of the first terminal 10 shown in FIG. 4(B). Accordingly, the cam portion 44 can move upwardly as much as the dimension of the S3B.

In the embodiment, the upward movement is regulated through the movable arm portion 22. Thus, the upward movement of the cam portion 44 is regulated through the movable arm portion 22 of the second terminal 20 at a position of the second terminal 20 in a terminal arrangement direction. Accordingly, even though the upward movement of the cam portion 43 at a position of the first terminal 10 appears to be possible, a regulation in the position of the second terminal 20 takes precedence to regulate the upward movement of the cam portion 43.

Accordingly, even though the pressing member 40 receives external force to be lifted, the cam portion 43 of the pressing member 40 will not be above the raised portion 11E. Thus, the cam portion 43 does not come off to a right direction in FIGS. 2(A) and (B). Further, a coming off of the cam portion 43 is prevented at the raised portion 11E. Accordingly, a coming off of the cam portion 44 to the right direction is also prevented. Thus, a prevention of the coming off of the cam portion 43 prevents the pressing member 40 from coming off from the housing 30.

As indicated by a hidden line in FIG. 4(B), the bottom edge of the movable arm portion 22 of the second terminal 20 in a portion to face the maximum rise position 11E-2 of the raised portion 11E of the first terminal 10 in a terminal longitudinal direction can be formed to protrude downwardly of the bottom edge of the movable arm portion 22 indicated by a phantom line.

Thus, a dimension of a space (S1B') formed between a bottom edge of the protruding portion indicated by a hidden line and the maximum rise position 11E-2 of the raised portion 11E of the first terminal 10 is to be smaller than a dimension (S1B) formed when the second terminal 20 having the movable arm portion 22 indicated by a phantom line is provided. As a result, the cam portions 43 and 44 will be even less likely to come off and an effect to prevent the pressing member 40 from coming off will be improved.

As described above, the side edge rotation portion 45 attempts to prevent the pressing member 40 from coming off in the both end positions of the terminal arrangement direction of the pressing member 40. However, even though the pressing member 40 is prevented from coming off in the both end positions, the pressing member 40 can be bent to come off if a width of the pressing member 40 in the terminal arrangement direction is large and the second terminal 20 does not regulate.

In the embodiment, as described above, the first terminal 10 and the second terminal 20 cooperate to prevent the cam portions 43 and 44 from coming off, respectively. Accordingly, the pressing member 40 is prevented from coming off from the housing 30. Further, the first terminal 10 and the second terminal 20 are arranged alternately and distributed all over the terminal arrangement direction. Further, the cam portions 43 and 44 are to be prevented from coming off in the distribution range.

Accordingly, an effect to prevent the pressing member 40 from coming off will be improved. That is, the deflection of the pressing member 40 will effectively prevent the pressing member 40 from coming off in the case in which the number of the terminal is large and a width of the pressing member in the terminal arrangement direction is large.

In the embodiment, the first terminal 10 and the second terminal 20 are arranged alternately. However, an order of the arrangement is not limited to the above. Instead, a similar effect will be obtained as far as the both terminals are distributed and arranged to be mixed in the terminal arrangement direction. Further, in the embodiment, the first terminal 10 and the second terminal 20 prevent the cam portions 43 and 44 from coming off, respectively, and no special member is required to prevent the cam portion from coming off. Accordingly, an enlargement of a connector can be prevented.

The connector according to the embodiment is used as follows. First, as shown in FIGS. 2(A) to 2(C), the pressing member 40 is risen to be in an open position. Further, a connection circuit portion is inserted to the flat conductor insertion space 34 provided in a left portion inside of the housing 30.

The connection circuit portion is an end portion of the flat conductor (not shown). In this regard, a surface of the connection circuit is to be positioned in a lower surface side to face the contact portions 11A and 21A of the terminals 10 and 20, respectively.

After the flat conductor is inserted to a specific position, and more specifically, a distal of the flat conductor is inserted to a depth adjacent to an adjacent portion of the housing 30, the pressing member 40 is rotated clockwise to a close position indicated by a phantom line in FIGS. 2(A) and 2(B).

When the pressing member 40 is at a close position, the cam portions 43 and 44 rotate around the rotation centers 43A and 44A, respectively, to be in a vertically long posture. The cam portions 43 and 44 press to displace the pressure receiving portions 12B and 22B of the terminals 10 and 20 upwardly, respectively.

Displacements of the pressure receiving portions 12B and 22B of the both terminals 10 and 20 incline the movable arm portions 12 and 22 of the terminals 10 and 20 in the form of a lever while having the joining portions 13 and 23 as a fulcrum, respectively, as indicated by a phantom line in FIGS. 2(A) and 2(B). As a result, each of the pressing portions 12A and 22A is elastically displaced downwardly to press the flat conductor so that a surface of the connection circuit of the flat conductor and the contact portions 11A and 21A of the terminals 10 and 20, respectively, are contacted each other.

In the embodiment, the pressure receiving portion 12B of the first terminal 10 is formed to be straight, while the pressure receiving portion 22B of the second terminal 20 is formed to be a recess. Accordingly, when the pressing member 40 is at a close position, one end portion of the cam portion 44 in FIG. 2(B) having a half circle shape engages with the pressure receiving portion 22B having a recess shape. That is, the pressure receiving portion 22B having a recessed shape plays a role in positioning the pressing member 40 at a close position.

When the first terminal 10 and the second terminal 20 are pressed fit to the housing from the opposite directions each other, an assembly error, and more specifically, a displacement between the terminals in a terminal longitudinal direction can occur. At this time, the pressure receiving portion 12B of the first terminal 10 and the pressure receiving portion 22B of the second terminal 20 are not positioned in the same positions in a terminal arrangement direction due to an assembly error.

In the embodiment, the pressure receiving portion 12B of the first terminal 10 is formed to be straight. Accordingly, when the pressing member 40 is at a close position, even though a position that is pressed by the cam portion 43 is slightly displaced to a terminal longitudinal direction, the pressure receiving portion 12B of the first terminal 10 is displaced upwardly without problems after being pressed by the cam portion 43. That is, the pressure receiving portion 12B that is formed to be straight allows the assembly error described above.

Second Embodiment

A second embodiment is different from the first embodiment in the two points. First, bottom edge portions of each of the movable arm portions of the first terminal and the second terminal are provided in the same position in a top-to-bottom direction. Second, when the pressing member is at an open position, a top-to-bottom dimension of the cam portion at a position of the second terminal in a terminal arrangement direction is made to be larger than a top-to-bottom dimension of the cam portion at a position of the first terminal.

In the second embodiment, the first terminal is to be identical to the first terminal 10 in the first embodiment in a shape and dimension. Further, the cam portion corresponding to a position of the first terminal in a terminal arrangement direction is to be identical to the cam portion 43 of the first embodiment in a shape and dimension.

Figure 5:
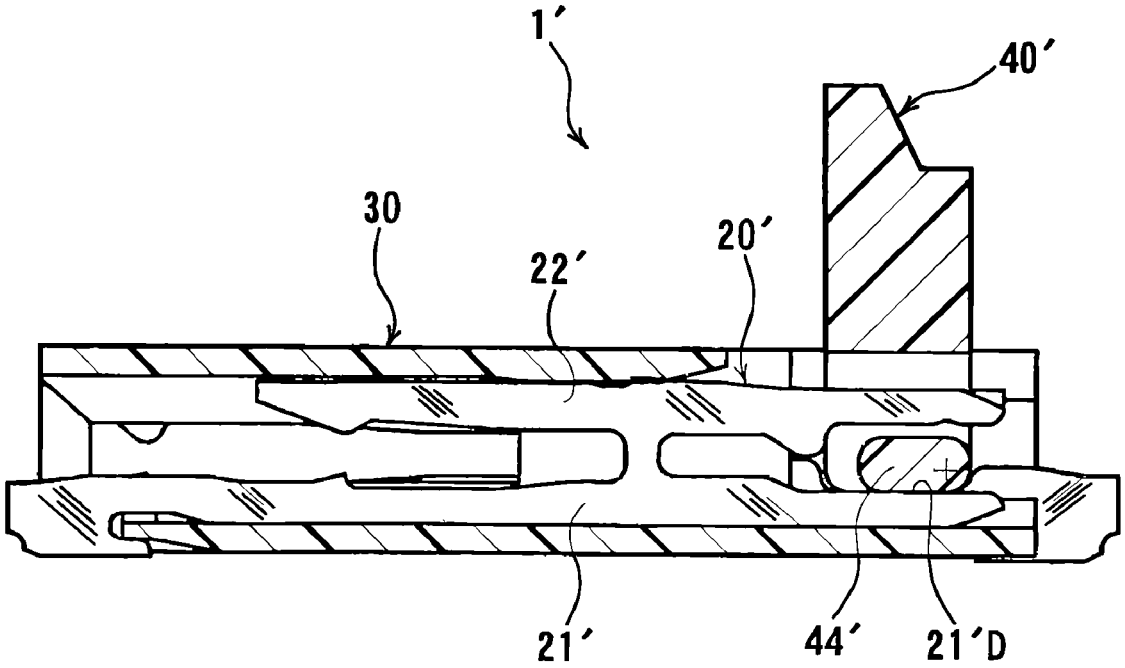
FIG. 5 is a sectional view of an electrical connector at a position of a second terminal in a terminal arrangement direction and corresponding to FIG. 2(B) according to a second embodiment of the present invention.
Figure 6:
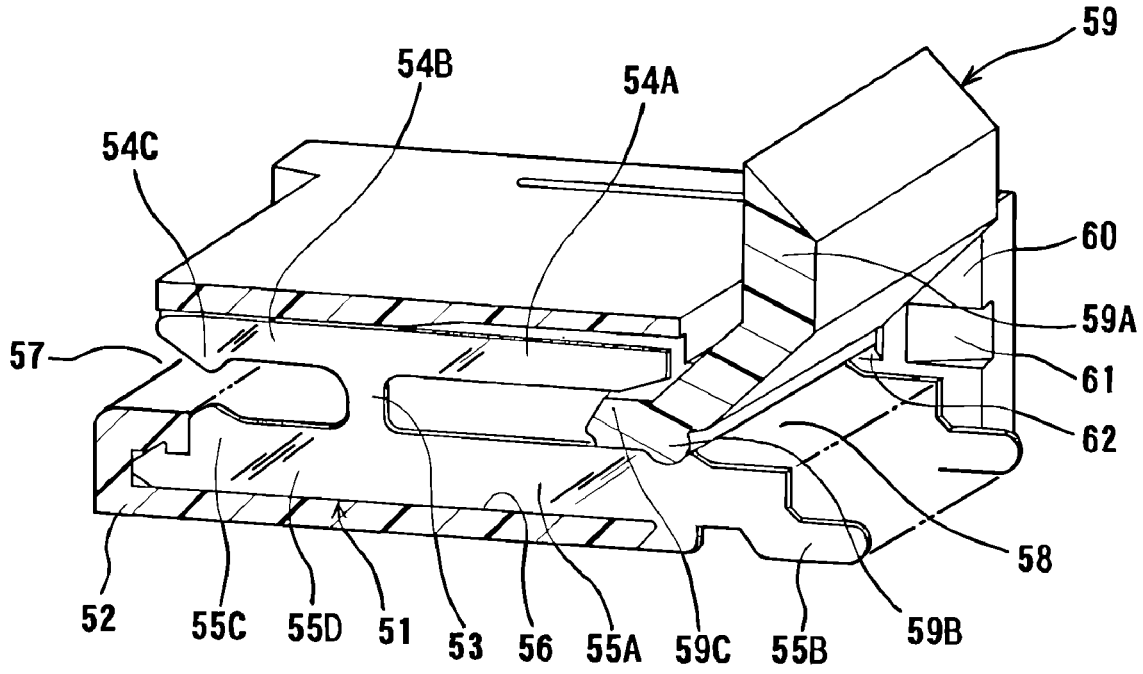
FIG. 6 Prior Art
FIG. 6 is a perspective sectional view showing a conventional electrical connector.
Figure 7:
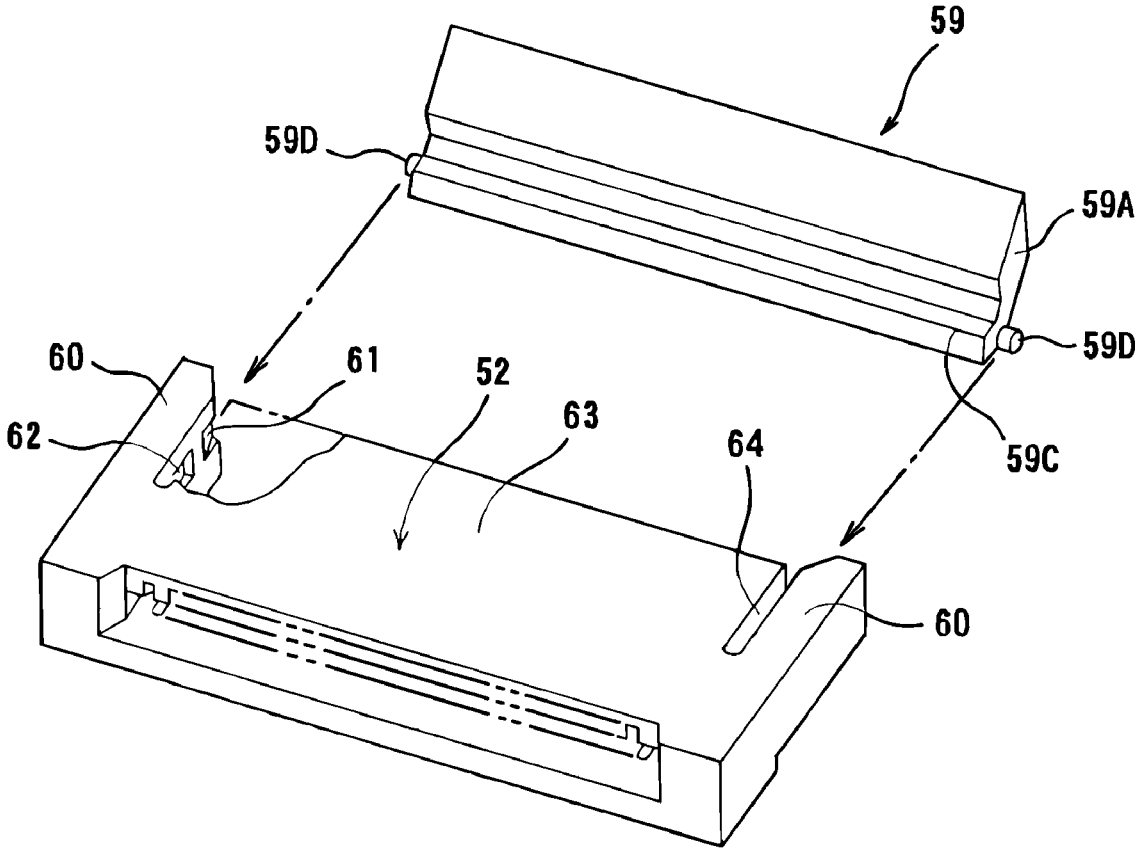
FIG. 7 Prior Art
FIG. 7 is a partial perspective sectional view showing the conventional electrical connector.

FIG. 5 is a sectional view of an electrical connector according to the second embodiment. FIG. 5 shows a section at a position of the second terminal in a terminal arrangement direction and corresponds to FIG. 2(B) that shows a section of the connector according to the first embodiment.

In the embodiment, the members that correspond to the first embodiment have the same codes as the first embodiment with "'" added. FIG. 5 is a sectional view at a position of the second terminal. Accordingly, the first terminal 10 and the cam portion 43 are not shown.

In the embodiment, bottom edge portions of the movable arm portion 12 and a movable arm portion 22' and top edge portions of the fixing arm portion 11 and a fixing arm portion 21' of the first terminal 10 and a second terminal 20' are provided in the same position in a top-to-bottom direction, respectively. The first terminal 10 and the cam portion 43 corresponding to a position of the first terminal 10 are identical to those of the first embodiment in shapes and dimensions. Accordingly, as described above, the cam portion 43 of the pressing member 40 can be inserted over when the connector 1' is assembled.

A cam portion 44' corresponds to a position of the second terminal 20' of a pressing member 40'. When the pressing member 40' is at an open position, a dimension of the top-to-bottom direction of the cam portion 44' is formed to be larger than a dimension in a top-to-bottom direction of the cam portion 43 corresponding to a position of the first terminal 10.

More specifically, a dimension in a top-to-bottom direction of a space formed between the bottom edge portion of the movable arm portion 22' and the cam portion 44' is formed to be smaller than a dimension of the maximum rise height of the raised portion 11E of the first terminal 10 at a position in which the cam portion 44' faces the cam guide portion 21'D having a straight shape of the fixing arm portion 21' of the second terminal 20'.

At this time, the cam portion 44' can move upwardly as much as the dimension of the space. Any more upward movement is to be regulated through the movable arm portion 22'. As described above, the upward movement of the cam portion 44' is regulated through the movable arm portion 22' of the second terminal 20' at a position of the second terminal 20' in a terminal arrangement direction. Accordingly, even though an upward movement of the cam portion 43 seems to be possible at a position of the terminal 10, a regulation at the position of the second terminal 20' is predominated. Thus, the upward movement of the cam portion 43 is to be regulated.

Accordingly, even though the pressing member 40' receives some kind of external force and is lifted, the cam portion 43 of the pressing member 40' will not be above the raised portion 11E. Accordingly, the cam portion 43 will not come off to a right direction in FIGS. 2(A) and (B). Further, due to the prevention of the coming off of the cam portion 43 in the raised portion 11E, a coming off of the cam portion 44' is also to be prevented. As described above, due to a prevention of the coming off of the cam portion 43, the pressing member 40' is prevented from coming off from the housing 30.

In the first and the second embodiments, the connector have two kinds of the terminals. The number of the kinds of the terminal is not limited to two, and may be more than three. Further, in the first and the second embodiments, the pressing member was to be a rotatable member. The pressing member can be a slidable member to be inserted into the housing.

In the first and the second embodiments, the contact portions 11A and 21A of the terminals 10 and 20, respectively, contact a circuit connection surface provided in a lower surface of the flat conductor to electrically connect. The contact connection surface is not limited to this way. For example, the pressing portions 12A and 22A of the terminals 10 and 20 can contact with the circuit connection surface provided on an upper face of the flat conductor, respectively, so that the pressing portions 12A and 22A function as the contact portion.

Alternatively, the pressing portions 12A and 22A and the contact portions 11A and 21A, respectively, can be contacted the circuit connection surfaces provided on both sides of the flat conductor. Further, each terminal can select a surface of the flat conductor to contact so that the selected surface can contact the contact portions 11A and 21A and the pressing portions 12A and 22A that are corresponding, respectively.

In the first and the second embodiments, as described above, the cooperation of the first terminal and the second terminal fully prevents the pressing member from coming off. However, a member to prevent the pressing member from coming off can be attached to improve the protection effectiveness.

For example, a member to prevent the side edge rotation portions that are provided on both ends of a longitudinal direction of the pressing member from coming off can be attached to both ends of the housing. Further, the first embodiment and the second embodiment can be combined to prevent the pressing member from coming off.

The disclosure of Japanese Patent Application No. 2007-024148, filed on Feb. 2, 2007 is incorporated in the application by reference.

While the invention has been explained with reference to the specific embodiments of the invention, the explanation is illustrative and the invention is limited only by the appended claims.

What is claimed is:

1. An electrical connector to be attached to a flat conductive member, comprising:

a housing having a bottom, wall, a top wall, a first receiving groove, and a second receiving groove, said first receiving groove and said second receiving groove extending from a first side toward a second side;

a first terminal disposed in the first receiving groove, said first terminal including a first fixing arm portion, a first movable arm portion, and a first connecting portion, said first fixing arm portion contacting with the bottom wall, said first movable arm portion contacting with the top wall so that the first terminal is tightly fitted between the bottom wall and the top wall;

a second terminal disposed in the second receiving groove, said second terminal including a second fixing arm portion, a second movable arm portion, and a second connecting portion, said second fixing arm portion contacting with the bottom wall, said second movable arm portion contacting with the top wall so that the second terminal is tightly fitted between the bottom wall and the top wall; and a pressing member disposed to be movable between an open position and a closed position for pressing the first terminal and the second terminal.

2. The electrical connector according to claim 1, wherein said first terminal is arranged to insert into the first receiving groove from the first side toward the second side.

3. The electrical connector according to claim 1, wherein said second terminal is arranged to insert into the second receiving groove from the second side toward the first side.

4. The electrical connector according to claim 1, wherein said first terminal further includes a first fixed groove at an end portion of the first fixing arm portion so that an edge of the bottom wall is accommodated in the first fixed groove at the first side.

5. The electrical connector according to claim 1, wherein said second terminal further includes a second fixed groove at an end portion of the second fixing arm portion so that an edge of the bottom wall is accommodated in the second fixed groove at the second side.

6. The electrical connector according to claim 1, wherein said first movable arm portion is arranged to contact with the top wall near the first connecting portion so that a distal end portion of the first movable arm portion is away from the top wall.

7. The electrical connector according to claim 1, wherein said second movable arm portion is arranged to contact with the top wall near the second connecting portion so that a distal end portion of the second movable arm portion is away from the top wall.

* * * * *